United States Patent [19]

Bungert et al.

[11] Patent Number: 4,671,197

[45] Date of Patent: Jun. 9, 1987

[54] SEWING MACHINE WITH STEP MOTOR OPERATED OSCILLATION DRIVE

[75] Inventors: Heinrich Bungert; Herbert Wenz, both of Kaiserslautern, Fed. Rep. of Germany

[73] Assignee: Pfaff Industriemaschinen GmbH, Fed. Rep. of Germany

[21] Appl. No.: 861,230

[22] Filed: May 8, 1986

[30] Foreign Application Priority Data

May 9, 1985 [DE] Fed. Rep. of Germany ..... 3516713

[51] Int. Cl.[4] ..... D05B 27/20; D05B 27/10

[52] U.S. Cl. ..... 112/310; 112/318; 112/453

[58] Field of Search ..... 112/310, 314, 315, 318, 112/322, 455, 121.11, 453, 320

[56] References Cited

U.S. PATENT DOCUMENTS

| | | | |
|---|---|---|---|
| 3,970,018 | 7/1976 | Hager | 112/310 |
| 4,295,435 | 10/1981 | Uemura et al. | 112/322 |
| 4,495,877 | 1/1985 | Willenbacher | 112/275 X |
| 4,583,476 | 4/1986 | Fischer | 112/275 |

*Primary Examiner*—Peter Nerbun

*Attorney, Agent, or Firm*—McGlew and Tuttle

[57] ABSTRACT

A sewing machine with a needle bar mounted in a rocker, has a step motor drive for the oscillation of the rocker. A memory is used in which are contained selected digital data for influencing the step motor and a control unit is inserted between the memory and the step motor for selection and conversion of the digital data into stepping pulses for the step motor. A pulse generator operating synchronously with a main shaft of the sewing machine is used for triggering the transmission of stepping pulses to the step motor. To improve the drive transmission and to avoid reactions on the step motor, the step motor is connected to a lever arm of the rocker via an eccentric transmission.

4 Claims, 6 Drawing Figures

SEWING MACHINE WITH STEP MOTOR OPERATED OSCILLATION DRIVE

FIELD AND BACKGROUND OF THE INVENTION

The present invention relates in general to sewing machines and in particular to a new and useful needle oscillation drive for a sewing machine which utilizes a step motor to rotate an eccentric transmission of the oscillation drive.

Sewing machines with step motor drives for the oscillation of the needle bar have been known up until now, only as zig-zag drives in household sewing machines. For the step motor drives used in the household sector, no such precision and accuracy is required as for industrial sewing machines. Due to the greater mass of the needle swinging drive existing in industrial sewing machines and also due to the required greater speed, much more stringent requirements and greater efficiency are set for such a swinging drive.

SUMMARY OF THE INVENTION

It is the object of the present invention to provide a step motor drive suitable for the swinging-out of a needle bar, which is suitable for smooth transmission of the motion supplied by the step motor to the needle bar rocker even at high speeds.

According to the invention, the problems of inaccuracy and low speed are solved by connecting the step motor to an eccentric transmission that moves a lever arm and rocker of the needle bar.

This results in the exceedingly great advantage that the dynamic reactions of the needle rocker drive to the step motor are negligibly small, as the reaction forces pass almost through the axis of the eccentric even in extreme positions of the eccentric drive.

A further object of the invention is to provide the eccentric transmission with an eccentric that is secured directly to the shaft of the step motor. The eccentric may also be provided with a bearing journal which is mounted for rotation in the housing and which is coaxial with the output shaft of the step motor.

A still further object of the present invention is to provide a sewing machine with a step motor-operated needle bar rocker that is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

One embodiment of the present invention is illustrated in the drawings wherein.

DESCRIPTION OF THE PREFERRED EMBODIMENT

Figure 1:
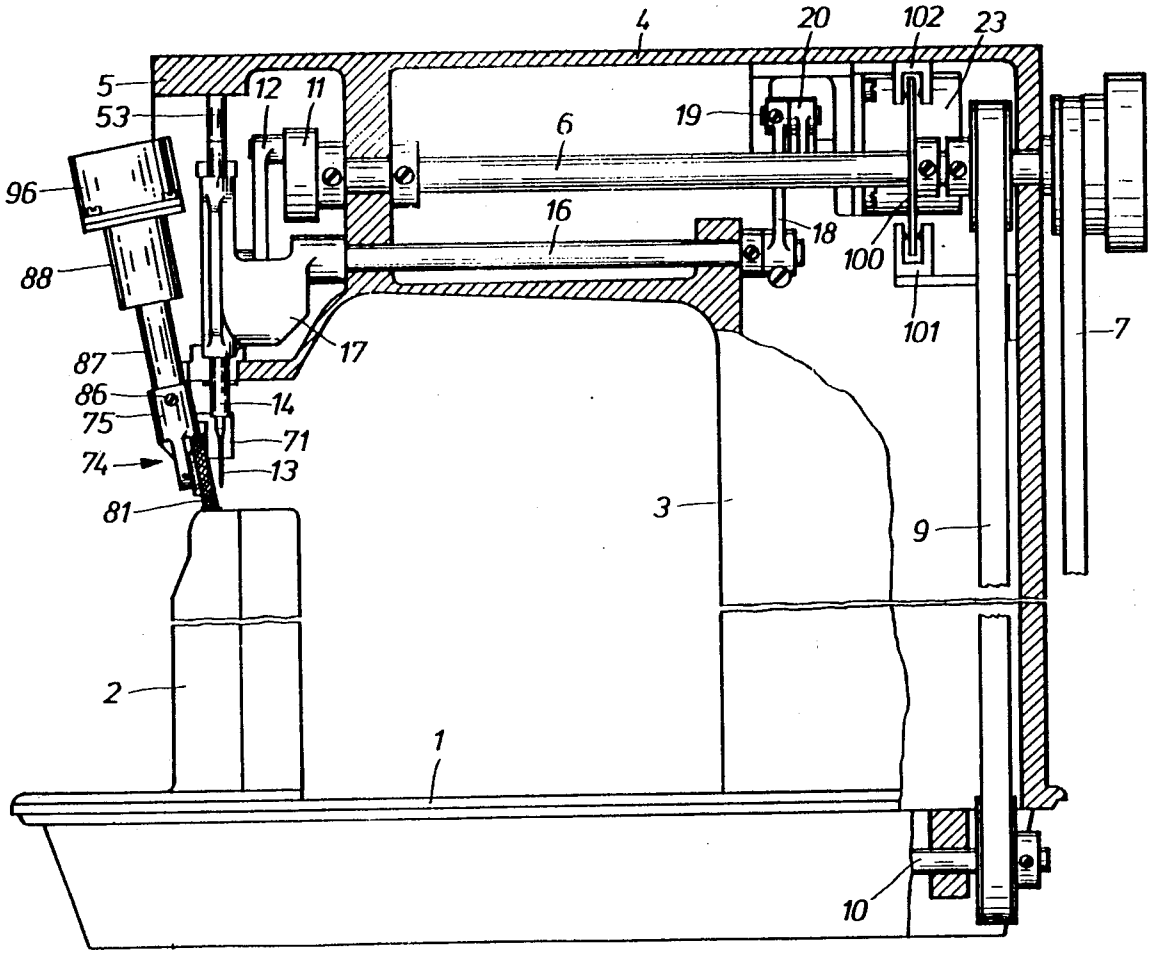
FIG. 1 is a front elevational view of a sewing machine equipped with needle advance of the invention, partly in section.
Figure 2:
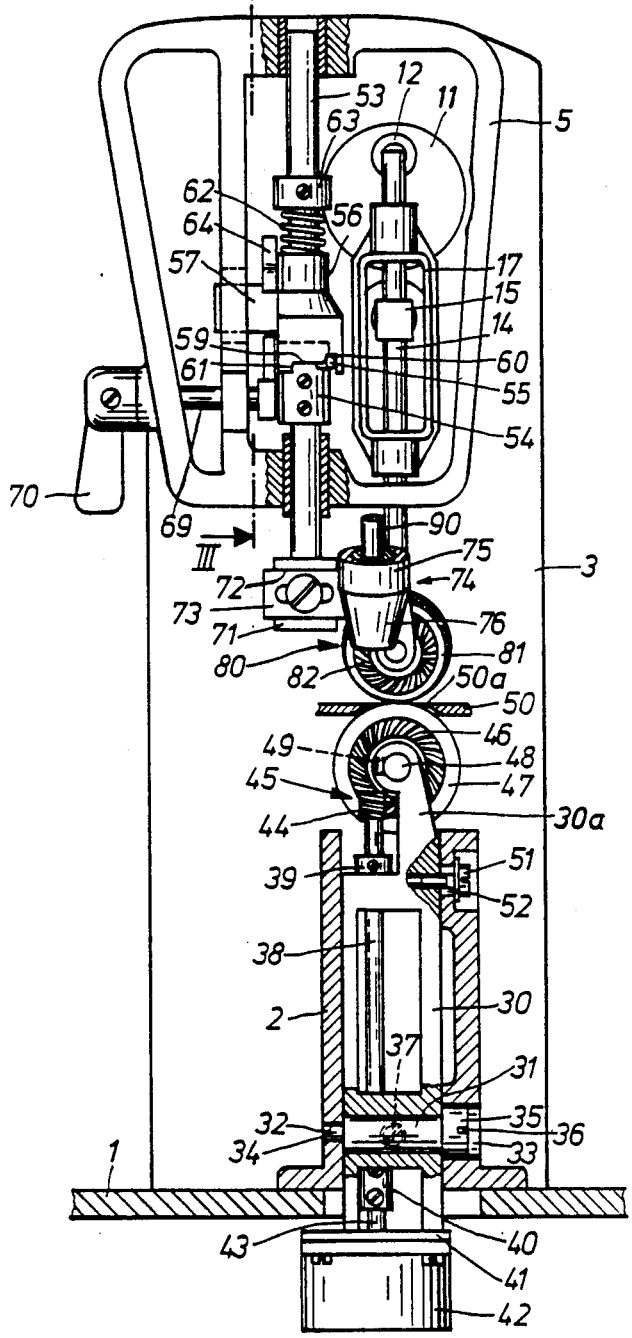
FIG. 2 is an enlarged side elevational view of the sewing machine according to FIG. 1, partly in section.

As shown in FIG. 1 above, the sewing machine consists of the base plate 1, column 2, standard 3, arm 4, and head 5, all forming a housing. In arm 4, a main shaft 6 is mounted in the usual manner, which is driven via a V-belt 7 by a motor (not shown) mounted below the base plate 1. From the main shaft there is driven, by a toothed belt 9, a rotary hook shaft 10 which is mounted in the base plate 1 and which is in drive connection with a rotary hook (not shown). Via a crank 11 and a link 12, the main shaft 6 drives a needle bar 14 equipped with a needle 13, in reciprocating up and down motion. Link 12 is articulated to the needle bar 14 via a joint 15 (FIG. 2).

The needle bar is mounted in a rocker 17 carried by a rocker shaft 16 (FIG. 1). The rocker shaft 16 is mounted parallel to the main shaft 6 in arm 4.

Figure 5:
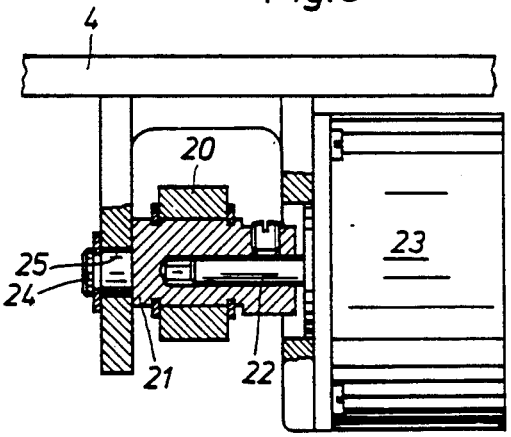
FIG. 5 is a back view of the step motor drive for the swinging-out of the needle bar, partly in section.

The end of the rocker shaft 16 protruding into the standard 3 carries a lever arm 18 which is connected to an eccentric bar 20 via a joint pin 19. The eccentric bar engages around an eccentric 21 (FIG. 5) which is firmly connected to an output shaft 22 of a step motor 23 secured in arm 4. The eccentric 21 is guided with a journal 24 in a bore 25 in the housing extending coaxially with the output shaft 22.

In the lower part of column 2 (FIG. 2) a support 30 is mounted on an eccentric bolt 31 which has bearing journals 34 and 35 protruding into bores 32 and 33 in column 2. Bearing journal 35 is provided with a slot 36. Eccentric 31 is clamped on support 30 by a screw 37. Mounted in support 30 is a vertical shaft 38 which is guided or held in the axial direction by an adjusting ring 39 and a coupling 40. At its lower end the support 30 is equipped with a flange plate 41 on which a step motor 42 is secured, whose output shaft 43 is coupled rigidly with the vertical shaft 38 by the coupling 40. At the upper end the vertical shaft 38 carries a pinion 44 of a spiroid gearing 45, the ring gear 46 of which is firmly connected to a sliding wheel 47 which is mounted with ball bearings, in known manner, and comprises an inner part with an axial end 48. The axial end 48 is received by a bore in an arm **30*a* of support 30 and can be fixed, after adjustment in the axial direction, by a screw 49**.

By rotation of the eccentric bolt 31 with the aid of slot 36, the sliding wheel 47 is adjustable over the support 30 in its height position relative to a stitch plate 50 which terminates column 2 at the top, and through which wheel 47 protrudes through a slot **50*a***.

The support 30 is fixed after adjustment on column 2, by a screw 51 which passes through a slot 52 in column 2 and which is screwed into the upper part of support 30. The sideways position of the sliding wheel 47 can be aligned relative to slot **50*a* in stitchplate 50 using axle end 48 and screw 49**.

A vertical shaft 53 is loosely mounted in the sewing machine head 5 for rotation and axial movement. On shaft 53 a clamping piece 54 is screwed tight. The piece 54 has a radial bore into which a pin 55 is pressed. A coupling piece 56 is loosely mounted on shaft 53. A lug 57 on its side protrudes through a slot in head 5 and secures the coupling piece 56 against rotation. The coupling piece 56 is formed in its lower region as a circular sector and embraces therewith the clamping piece 54. The circular sector has a recess 59 into which the pin 55 protrudes and which terminates at one end in a ratchet groove 60, while at its other end it terminates in a wall 61. A compression spring 62, which braces itself against an adjusting ring 63 fastened on shaft 53, pushes the coupling piece 56 and hence the upper wall of its circular sector slightly downward against pin 55.

Figure 3:
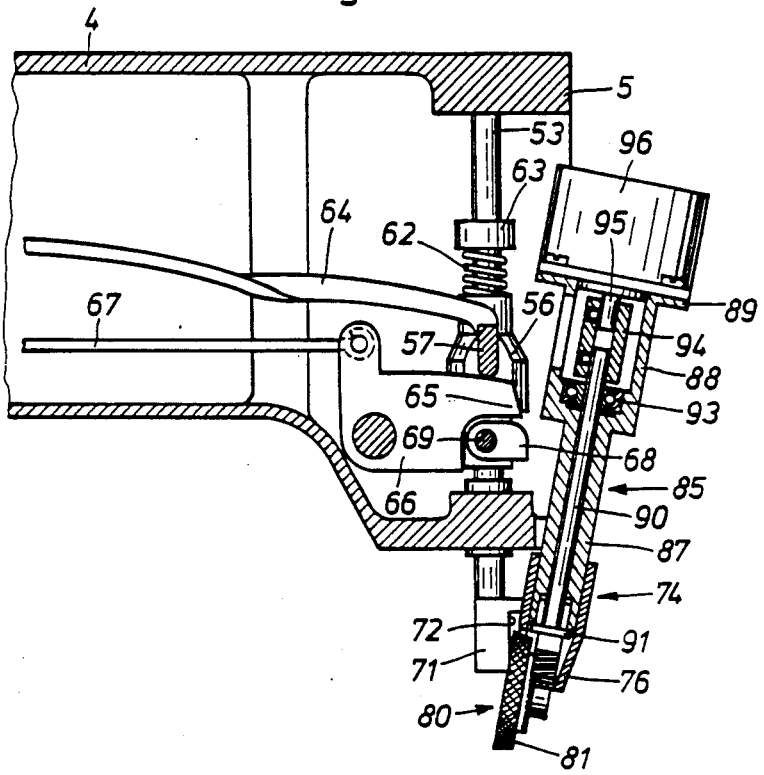
FIG. 3 is a sectional view taken along line III—III of FIG. 2.

On lug 57 (FIG. 3) rests the free end of a leaf spring 64 which is fastened in arm 4 and pushes the coupling piece 56 downward. Protruding after lug 57 is a lever arm 65 of an angle lever 66 mounted in head 5, which lever is connected through a link 67 with a lifting linkage (not shown) to be actuated by the operator. Under the lever arm 65, a cam 68 is fastened on a shaft 69 mounted in head 5. On its end extending to the outside, shaft 69 carries a hand lever 70 (FIG. 2).

Figure 4:
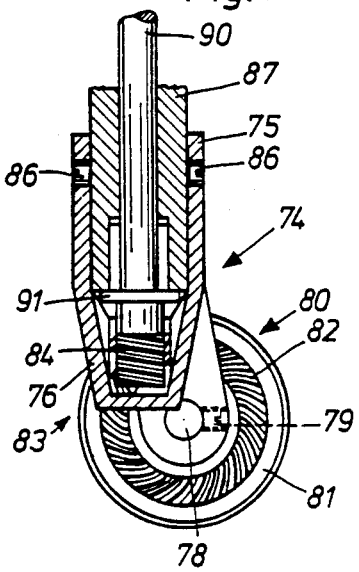
FIG. 4 is an enlarged sectional view taken through a part of the roll foot drive mechanism.

At the lower end of shaft 53 a block 71 is fastened, which is equipped with a groove guideway 72. An angular slotted lobe 73 is screwed tight in the guideway 72. Lobe 73 is firmly connected to a roll foot carrier 74. The carrier 74 comprises a tubular piece 75 (see also FIGS. 3 and 4) which terminates in a downwardly extending end piece 76. In it a bore is provided for attachment of an axle end 78 of a ball-bearing roll foot 80 by a screw 79. Roll foot 80 has a race 81 firmly connected to a ring gear 82 of a spiroid gearing 83 whose pinion 84 is eccentrically in engagement with the ring gear 82. Received in the tubular piece 75 is a tubular support 85 which is fixed in its position by screws 86 inserted in tubular piece 75. The support 85 consists of a tube 87, a hollow cylinder 88 directly above it, and an annular end flange 89. Mounted in tube 87 is a shaft 90 which carries at its lower end the pinion 84 and is firmly connected to an annular shoulder 91 which abuts against the lower end of tube 87.

In the region of its upper end, shaft 90 is embraced by the inner race of a ball bearing 93 pressed into the hollow cylinder 88. The upper end of shaft 90 is coupled rigidly with an output shaft 95 of a step motor 96, whose housing is screwed tight on the end flange 89.

Figure 6:
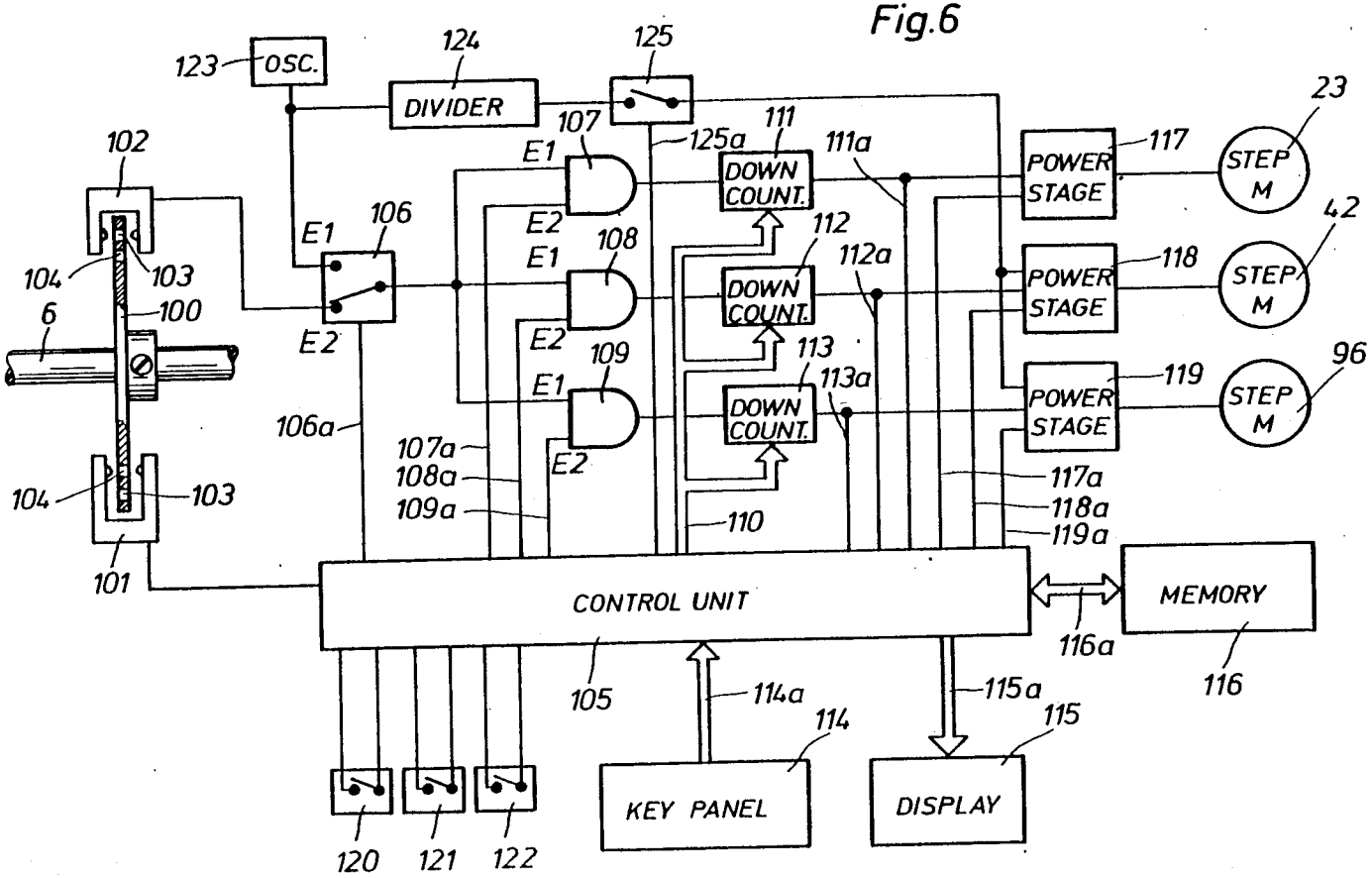
FIG. 6 is a block circuit diagram of the electronic circuit for the forward feed device of the invention.

A strobe disk 100 is mounted on the main shaft 6 (FIG. 1) of the sewing machine, which has two pulse tracks, each cooperating with a pulse generator 101, 102. One track comprises a plurality of pulse markers 103 uniformly distributed on its circumference (FIG. 6), while the other track has only two pulse markers 104, one of which passes by the pulse generator 101 as needle 13 emerges from the workpiece, while the other does so when needle 13 enters the workpiece.

The pulse generator 101 is connected to a control unit 105. Control unit 105 is connected via a control line 106*a* to a reversing arrangement 106 and, via control lines 107*a* 108*a* and 109*a*, to AND elements 107, 108 and 109 respectively. A bus line 110 connects counters 111, 112 and 113 to unit 105 Further, there are connected to the control unit 105 via a bus line 114*a*, a key panel 114, via a bus line 115*a* a display unit 115, and via a bus line 116*a* a data memory 116.

The outputs of the counters 111, 112 and 113 are connected to inputs of power stages 117, 118 and 119 for the respective step motors 23, 42 and 96. Further, the outputs of the counters 111, 112 and 113 are connected to the control unit 105 via lines 111*a*, 112*a* and 113*a*. Lines 117*a*, 118*a* and 119*a* lead from the control unit 105 to the power stages 117, 118 and 119. Also connected to the control unit 105 are three switches 120, 121 and 122, of which switch 120 serves to actuate a backward sewing process, while the two switches 121 and 122 are provided for slow drive of the step motors 42 and 96 in forward and backward directions respectively during standstill of the sewing machine, preferably in a needle-up position. To this end an oscillator 123 is connected to the two power stages 118 and 119 via a divider 124 and a switch 125. Switch 125 is connected to the control unit 105 via a control line 125*a*. In addition, oscillator 123 is connected to the input E1 of the reversing arrangement 106, whose input E2 is connected to the pulse generator 102. The output of the reversing arrangement 106 leads to the inputs E1 of the three AND elements 107, 108 and 109, whose outputs are connected to the respective counters 111, 112 and 113, which are designed as downcounters and which are presettable singly by the control unit 105 via the bus line 110.

With the key panel 114 one can preselect the number of steps of the step motors 23, 42 and 96 to be executed per sewing stitch and hence the feed length of the individual transport elements—needle 13, sliding sheel 47 and roll foot 80—between each stitch formation, with the possibility of setting different feed amounts of the sliding wheel 47 relative to the roll foot 80. The preselected stitch length is indicated in the display unit 115.

The device operates as follows:

Via the key panel 114, the operator sets the desired feed amounts of the needle 13, of the sliding wheel 47 and of the roll foot 80, corresponding digital values being taken out of the data memory 116 via the control unit 105 and thus the counters 111, 112 and 113 preset. At the same time, values corresponding to the feed amounts are indicated in the display unit 115.

During operation of the sewing machine, the sewing motor (not shown) drives the V-belt 7 and thus the main shaft 6 which moves the needle bar 14 up and down via the drive connection of crank 11 and link 12. In addition, via the toothed belt 9 and the rotary hook drive shaft 10, the main shaft 6 drives the rotary hook (not shown). The drive for advancing of the workpiece is actuated via the pulse generator 101 whenever the needle 13 penetrates into the workpiece and when it leaves the workpiece again The pulse generator 101 then sends a pulse to the control unit 105. Via the control lines 107*a*, 108*a* and 109*a*, the control unit 105 now switches the potential at the inputs E2 of the AND elements 107, 108 and 109 to the counters 111, 112 and 113 via the reversing arrangement 106 switched to input E2 during drive of the sewing machine.

When one of the counters 111, 112 or 113 has reached the status "0", it delivers a control pulse to the respective power stage 117, 118 or 119, whereby the corresponding step motor 23, 42 or 96 is advanced by one step. At the same time this counter 111, 112 or 113 delivers, via the associated control lines 111*a*, 112*a* or 113*a*, a pulse to the control unit 105, which again presets this counter 111, 112 or 113 to a new value. The control unit 105 calls the corresponding values out of the data memory 116. At the same time the control unit 105 determines, via the control lines 117*a*, 118*a* and 119*a* connected to the power stages 117, 118 and 119, whether the particular step motor 23, 42 or 96 is being moved forward or backward. The values presettable at the counters 111, 112 and 113 are chosen so that the step motors 23, 42 and 96 can execute their maximum number of steps in the withdrawn phase of the needle 13 as well as in its inserted phase.

The stepping pulses acting on the step motors 23, 42 and 96 drive the rocker 17, the sliding wheel 47 and the roll foot 80 for joint transport action on the workpiece. Via the vertical shaft 38 firmly coupled with its output shaft 43 and via the miter gear 45, the step motor 42 rotates the sliding wheel 47, while step motor 96 drives at the same time the roll foot 80 via the shaft 90 firmly coupled with its output shaft 95 and via the miter gear 83. Step motor 23 rotates at the same time, via its output shaft 22, the eccentric 21 stepwise in one direction, which transmits these deflection movements of its eccentricity to the rocker 17 via the eccentric rod 20 and the lever arm 18, causing the rocker to swing out by corresponding angle amounts. This takes place with needle 13 inserted in the workpiece synchronously with the advance of the sliding wheel 47 and of the roll foot 80, and with the needle withdrawn by drive of the eccentric 21 in the opposite direction.

In the feed direction, the needle bar 14 executes, in known manner, a sinusoidal swinging motion. During its phase with needle 13 inserted in the workpiece, it swings in the forward direction and during the withdrawn phase it swings in the opposite direction. For this reason the control of step motor 23 for the swinging-out of the needle bar 14 is laid out so that it imparts to the step motor 96 during one revolution of the main shaft 6, that is, with every advance between two stitch formations, two sinusoidal partial step sequences, of which one drives the step motor 23 in forward direction and the other in a direction opposite thereto. Advantageously the drive of the step motors 42 and 96 for the sliding wheel 47 and for the roll foot 80 occurs, again not as a constant sequence of steps, but in two sinusoidal partial step sequences.

After the individual step motors 23, 42 and 96 have traveled the number of steps set on the key panel 114 and depending on the correspondingly called data values from the data memory 116, the input E2 of the respective AND element 107, 108 or 109 is switched to L (low) potential by the control unit 105 via the control line 107*a*, 108*a* or 109*a*, so that by the corresponding AND element 107, 108 or 109, further passage of clock pulses from the pulse generator 102 is suppressed.

For backward sewing, for example for making a bar at the end of a seam, switch 120 is actuated, whereby, at the beginning of a new pulse from the pulse generator 101 via the control lines 117*a*, 118*a* and 119*a* at the power stages 117, 118 and 119, the control unit 105 reverses the direction of movement of the step motors 23, 42 and 96, so that they drive the sliding wheel 47, the roll foot 80 and the needle bar 14 in reverse direction, as long as the actuation of switch 120 lasts. Execution of the step sequence of the step motors 23, 42 and 96 occurs by polling of the respective values set in the key panel 114 from the data memory 116 in the manner described above.

During the stopping process of the sewing machine, which usually ends in the upper dead center of needle 13, the control unit 105 switches the reversing arrangement 106 to input E1, so that the pulses delivered by oscillator 123 are applied to the inputs E1 of the AND elements 107, 108 and 109. As soon as the sewing machine stops, clock pulses from oscillator 123 are thus placed on the inputs E1 of the AND elements 107, 108 and 109 instead of the clock pulses from pulse generator 102. In this manner the preselected advance of needle 13, of sliding wheel 47 and of roll foot 80 is completed also after the last emergence of needle 13 from the work, so that needle 13 is already above the next needle insertion point. As soon as the end position of the preselected feed amount has been reached, the control unit 105 turns the AND elements 107, 108 and 109 off via the control lines 107*a*, 108*a* and 109*a*.

To correct the position of the workpiece relative to needle 13 as it results when the sewing machine is stopped, slow transport of the workpiece in the forward feed direction while the sewing machine is turned off is possible by actuation of switch 121. Slow transport of the work in the backward direction is possible when the sewing machine is off, by actuation of switch 122. Actuation of the respective switch 121 or 122 brings about a closing of switch 125 via line 125*a*, so that pulses delivered by oscillator 123 and forwarded in reduced frequency from the divider 124 are sent to the two power stages 118 and 119, whereby the two step motors 42 and 96 are driven slowly for the drive of the sliding wheel 27 and of the roll foot 80. The movement direction of the step motors 42 and 96 is then set for forward or backward rotation via the control lines 118*a* and 119*a* at the power stages 118 and 119, depending on the actuation of switch 121 or 122.

The roll foot 80 is lifted off the work by turning the hand lever 70, with the cam 68 raising the coupling piece 56, via lever arm 65 of angle lever 66, over the lug 57 counter to the pressure of leaf spring 64. The same effect results also by actuation of the lifting linkage (not shown) which rotates the angle lever 66 via link 67.

Via the compression spring 62, the coupling piece 56 raises shaft 53 with the roll foot 80 fastened thereto and with the support 85. The compression spring 62 ensures the abutment of pin 55 in the ratchet groove 60 of the coupling piece 56.

To pivot the roll foot 80 downward, the latter is rotated by hand about the axis of shaft 53. Pin 55 then disengages from the ratchet groove 60 counter to the force of the compression spring 62, and shaft 53 can be rotated to bring pin 55 into abutment on wall 61 of recess 59.

The above described rocker drive is, of course, not limited to sewing machines with forward feed of the needle, but with appropriate modification it can be used also for the swinging out of the needle bar crosswise to the forward direction and hence to produce a zig-zag movement.

While a specific embodiment of the invention has been shown and described in detail to illustrate the application of the principles of the invention, it will be understood that the invention may be embodied otherwise without departing from such principles

What is claimed is:

1. A sewing machine comprising, a housing, a main shaft rotatably mounted in said housing, a needle bar mounted for reciprocating and swinging motion in said housing, reciprocating means operatively connected between said main shaft and said needle bar for reciprocating said needle bar, a rocker mounted for swinging motion in said housing and receiving said needle bar for swinging said needle bar, a lever arm connected to said rocker for swinging said rocker, eccentric transmission means operatively connected to said lever for moving said lever to swing said rocker, a step motor having an output shaft connected to said eccentric transmission means, said step motor receiving stepping pulses for rotating said output shaft to move said eccentric transmission means and thus move said lever arm, a memory for storing digital data corresponding to selected movements of said step motor output shaft for selected swinging movements of said needle bar, a control unit connected between said memory and said step motor for selecting digital data from said memory and for forming stepping pulses from said selected digital data and for said step motor, and a pulse generator operating synchronously with rotation of said main shaft and connected to said control unit for triggering the transmission of stepping pulses to said step motor, said transmission means comprising an eccentric fixed to said output shaft of said step motor.

2. A sewing machine according to claim 1 including a bearing journal connected to said eccentric and rotatably mounted to said housing coaxially with said output shaft of said step motor.

3. A sewing machine according to claim 1 wherein said pulse generator comprises a disk connected to said main shaft for rotation therewith and having markings thereon, and a marking sensor affixed to said housing and connected to said control unit for applying pulses to said control unit with passage of said markings.

4. A sewing machine according to claim 1 wherein said step motor is fixed to said housing with said output shaft thereof extending parallel to said main shaft, said eccentric transmission means including an eccentric having a bearing journal affixed to said housing for rotation about an axis which is coaxial to said output shaft of said step motor, said eccentric being fixed to said output shaft of said step motor, a rocker shaft fixed between said rocker and said lever arm and rotatably mounted to said housing, said rocker shaft extending parallel to said main shaft.

* * * * *